US007326108B2

(12) United States Patent
Matthews et al.

(10) Patent No.: US 7,326,108 B2
(45) Date of Patent: Feb. 5, 2008

(54) VENTILATION DEVICE

(75) Inventors: Geoffrey Matthews, Oxford (GB); Andrew Hamshere, Buckinghamshire (GB); Joseph Stone, Buckinghamshire (GB); Oliver Bishop, Hampshire (GB); Andrew Forbes, West Sussex (GB); Brian Blackburn, Buckinghamshire (GB)

(73) Assignee: Airflow Developments Limited, High Wycombe, Buckinghamshire (GB)

( * ) Notice: Subject to any disclaimer, the term of this patent is extended or adjusted under 35 U.S.C. 154(b) by 78 days.

(21) Appl. No.: 11/059,180

(22) Filed: Feb. 16, 2005

(65) Prior Publication Data

US 2006/0199523 A1 Sep. 7, 2006

(51) Int. Cl.
*F24F 7/00* (2006.01)

(52) U.S. Cl. ..... 454/259; 454/319

(58) Field of Classification Search ..... 454/259, 454/309–310, 317, 319, 320
See application file for complete search history.

(56) References Cited

U.S. PATENT DOCUMENTS

| | | | | |
|---|---|---|---|---|
| 2,649,272 | A | 8/1953 | Barbato | |
| 6,276,895 | B1 * | 8/2001 | Milana | 415/25 |

FOREIGN PATENT DOCUMENTS

| | | | |
|---|---|---|---|
| GB | 895367 | | 5/1962 |
| GB | 965744 | | 8/1964 |
| GB | 1480874 | | 7/1977 |
| GB | 2227550 | A | 8/1990 |
| GB | 2272970 | A | 6/1994 |
| GB | 2273152 | A | 6/1994 |
| WO | 99/47839 | A1 | 9/1999 |

OTHER PUBLICATIONS

Search Report by UK Patent Office, Apr. 5, 2004.

* cited by examiner

*Primary Examiner*—Steven B. McAllister
*Assistant Examiner*—Helena Kosanovic
(74) *Attorney, Agent, or Firm*—Levisohn Berger LLP

(57) ABSTRACT

In order to provide a simple design of ventilation device which has a relatively open aperture of pleasing aesthetic appearance, there is provided a face 2 for facing into a room, the face including an aperture 3. Three closure parts 5 are provided for closing the aperture 3. The closure parts 5 are rotatably mounted adjacent to the aperture 3 about pivots 9 located around the periphery of the aperture. A drive means is provided for moving the closure parts between an open position and a closed position. A suitable fan 6 can be provided for drawing air through the aperture when the closure parts are in the open position. In a first aspect of the invention, the closure parts 5 each comprise closures surfaces having edges, the edges abutting one another in the closed position. In a second aspect of the invention, there is drive member 12 for contacting a drive part 11 of a closure part 5, the drive part 11 being located close to the pivot 9. In a third aspect of the invention, the drive means 12 is configured to act on a drive part 11 of each closure part, the pivot 9 and the drive part 11 being mounted on the same side of the closure part 5.

8 Claims, 3 Drawing Sheets

VENTILATION DEVICE

The present invention relates to a ventilation device.

Ventilation devices are very widely known for ventilating rooms such as domestic spaces, works spaces, hospitals, storage areas etc. In use, the ventilation device comprises a fan or other device for extracting air from the space or directing air into it. However, when the ventilation device is not in use, it is required to close the ventilation device so that unwanted air movement through the device is prevented.

GB2227550 in the name GEC—XPELAIR LIMITED discloses a shutter mechanism for a ventilation fan.

In a first embodiment, the shutter mechanism comprises a number of blades forming a louvre shutter. In a second embodiment, an iris shutter is disclosed, which has an open position in which air can pass through the shutter and a closed position in which air does not pass through the shutter.

Whilst louvre mechanisms are very widely used, the present inventors have realised that the iris mechanism may be preferable for aesthetic reasons. However, the iris mechanism disclosed in the document GB2227550 has the disadvantage that it is relatively bulky and, in the open position, does not provide a very large free flow area, the blades of the iris mechanism partly obscuring the opening.

The present inventors have realised that an iris type mechanism can be provided which completely opens the aperture in the open position, without any obstructing features remaining in the aperture. In order to achieve this, the blades of the iris mechanism must be pivoted at the outer periphery so that they rotate outwardly from the aperture.

In a first aspect, the present invention provides a ventilation device having a ventilation device, having:

a face for facing into a room, the face including an aperture;

at least three closure parts, for closing the aperture, rotatably mounted adjacent to the aperture about pivot points located around the periphery of the aperture, wherein the closure parts each comprise closure surfaces having edges, the edges abutting one another in the closed position, drive means for moving the closure parts between an open position and a closed position, and fan means for driving air through the aperture when the closure parts are in the open position.

In a second aspect, the present invention provides a ventilation device, having:

a face for facing into a room, the face including an aperture;

at least three closure parts, for closing the aperture, rotatably mounted adjacent to the aperture about pivot points located around the periphery of the aperture, drive means for moving the closure parts between an open position and a closed position, the drive means comprising at least one drive member for contacting a drive part of a closure part, the drive part being located close to the pivot, and fan means for driving air through the aperture when the closure parts are in the open position.

In a third aspect, the present invention provide a ventilation device having:

a face for facing into a room, the face including an aperture;

at least three closure parts, for closing the aperture, rotatably mounted adjacent to the aperture about pivot points located around the periphery of the aperture, drive means for moving the closure parts between an open position and a closed position, the drive means being configured to act on a drive part of each closure part wherein the pivot and the drive part are mounted on the same side of the closure part, and fan means for driving air through the aperture when the closure parts are in the open position.

By mounting the closure parts around the periphery of the aperture, they can be removed completely from the aperture in the open position. This is different to the system shown in GB2227550, in which the vanes of the iris mechanism are pivoted nearer to the centre of the operating mechanism, which therefore always obscures the centre of the aperture.

The term "Iris mechanism" is widely used for a type of closure like the iris on a camera in which a plurality of planar members arranged in a mutually overlapping configuration can, by relative rotation, slide over one another to increase or decrease the size of a space between them. Whereas such as a mechanism can be used in the second or third aspects of the present invention, it is particularly preferred if the closure parts do not slide over one another. This particularly advantageous in a ventilation device, because it is frequently the case that air withdrawn from a space contains a certain amount of dust of grease which inevitably settles on the surfaces in the ventilation device. If the closure parts slide over one another, there is a problem that they will become jammed by dirt. Accordingly, in the first aspect of the invention and preferably in the second and third aspects of the invention, the closure parts each comprise closure surfaces having edges, the edges abutting one another in the closed position. In this way, opening is achieved by simply moving the closure parts away from one another so that they do not slide over one another.

In all aspects of the invention the closure parts can have any suitable shape. Preferably, they rotate about axes which are substantially normal to the plane of the aperture. Preferably, they are geometrically the same. This simplifies construction and gives an enhanced aesthetic appearance. The edges which abut one another, if present, may each be straight or they may be curved. The closure surfaces may be substantially flat or they may each comprise a sector of a curved surface. Preferably, the degree of curvature is relatively small, to simplify the design of space into which the closure parts move in the open position.

There may be more than three closure parts, if required.

In order to transfer drive from the drive means to each closure part, each closure part preferably comprises a drive part, the drive part being engageable with a drive member. The drive member may comprise a single drive member engaging all the drive parts of all the closure parts or a separate drive member may be provided for each closure member.

In the second aspect of the invention, and preferably in the first and third aspects of the invention, the drive part is located on the closure part relatively close to the pivot. In this way, the degree of movement of the drive part required in order to move the closure part from the closed position to the open position may be relatively small. This is particularly advantageous with modem drive devices, such as wax actuators, which are described below. Suitably, the distance between the pivot and the drive part is less than half and preferably less than a quarter of the maximum extent of the closure part from the pivot.

In the third aspect of the invention, and preferably in the first and third aspects of the invention, the pivot and the drive part of each closure member are located on the same side of the closure part. Suitably, they are both located on the side of the closure part which faces away from the face which faces into the room. This means that the depth of the ventilation device from the face which faces into the room need not be very great, which is an advantage in the design of ventilation devices, particularly for aesthetic reasons.

In a particularly preferred embodiment, the drive member comprises at least a part of an annular member which is slidably mounted in an annular track. This annular member can be driven through the required angular distance in order to open the closure members. A single drive member structure can therefore be provided for transferring drive from just one source of motive power to all of the closure parts in a particularly simple way.

The drive member itself may be driven by any suitable means, for example an electric motor operating via a cog, rack and pinion, reduction gear or any known mechanism. However, in a preferred embodiment, the drive member is operated by a wax actuator. Wax actuators are well known in this art and can provide a drive with a relatively short stroke which is highly suitable for operating the present invention. The wax actuator is, in use, supplied with heat by an electrical current which is switched on automatically when the fan is switched on. In this way, a particularly simple mechanism is provided for coordinating the opening of the aperture with the operation of a ventilation fan.

Closure drive means may be provided for driving the closure parts from the open to the closed position. The closure drive means may be the same as the drive means for moving the closure parts from the closed position to the open position. Suitably, resilient means, for example a coil spring, may be provided for returning the closure parts to the closed position after the drive means which opened the closure parts has ceased to operate.

The fan means is provided for withdrawing air from a room or directing air into the room. Any conventional fan means or impeller may be used.

The ventilation device may comprise any conventional pieces of equipment.

A switch may be provided for operating the drive means. In a preferred embodiment, as described above, the switch allows the drive device to operate to open the closure parts. When the switch is switched off, the drive device ceases to operate and resilient means returns the closure parts to the closed position. The switch means may further comprise switching means for switching on or off the fan means, the fan means being switched on when the closure parts are opened and switched off when the closure parts are closed.

The switch may form part of a control module of a type known in the art. The control module may operate in response to external temperature, humidity, in response to a passive infra red sensor or in accordance with a timing schedule. Manually operable switches may be provided, for example a pull cord, switch or remote control.

Preferably, when the fan is switched off, the closure parts are automatically closed.

The ventilation device may be manufactured to any suitable size, depending upon the air flow volume required. The skilled person will be able to determine the size of the aperture and the power of fan means required in order to achieve a desired airflow rate.

The ventilation device may be constructed of any suitable material as is known in the art. For example, the closure parts may be composed of metal or synthetic material, for example thermoplastic.

The present invention will be further described by way of example only with reference to the accompanying drawings, in which:

DETAILED DESCRIPTION OF THE DRAWING

Figure 1:
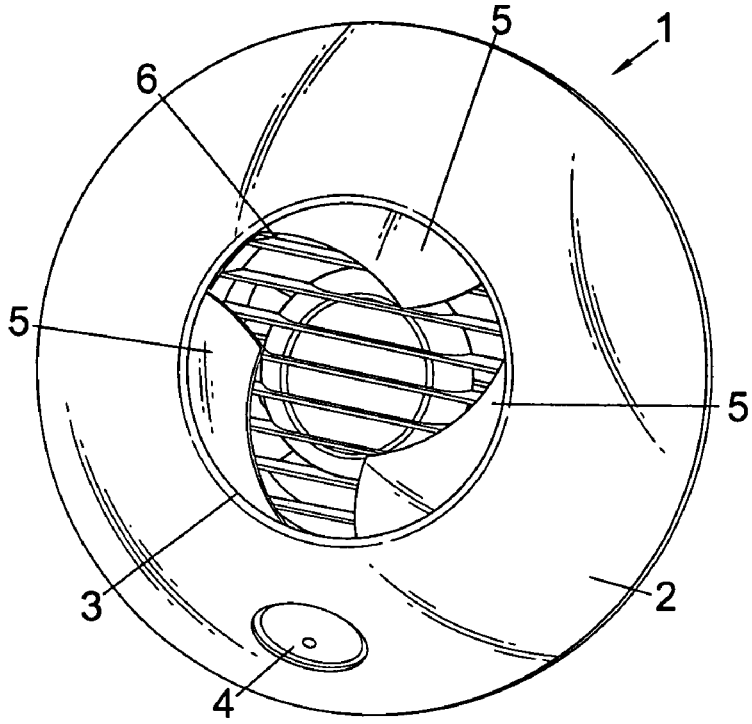
FIG. 1 is sketch isometric view of a ventilation device according to the first, second and third aspects of the present invention.

FIG. 1 shows a sketch isometric view of a ventilation device according to the first, second and third aspects of the present invention. It comprises a face plate 2, for facing into a room, the face plate defining a generally circular aperture 3. The face plate further includes a sensor 4. The aperture 3 is shown partly closed by three closure parts 5.

Behind the closure parts 5 there is located a grille and an impeller fan 6 of conventional design which will not be described further.

Figure 2:
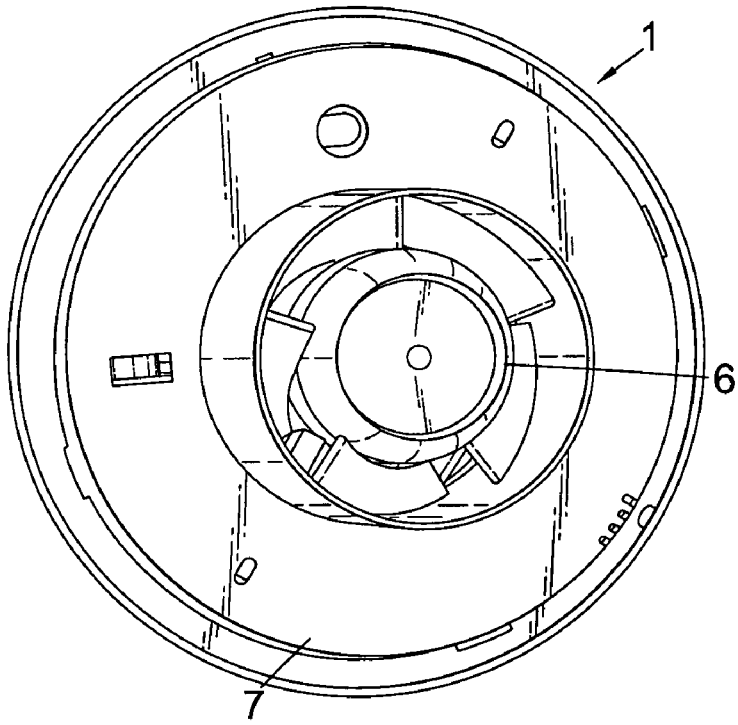
FIG. 2 is sketch isometric rear view of the ventilation device of FIG. 1.

FIG. 2 shows the ventilation device 1 from the rear. A base plate 7 can be seen. The impeller fan 6 is mounted in an annular space surrounded by the base plate 7.

Figure 3:
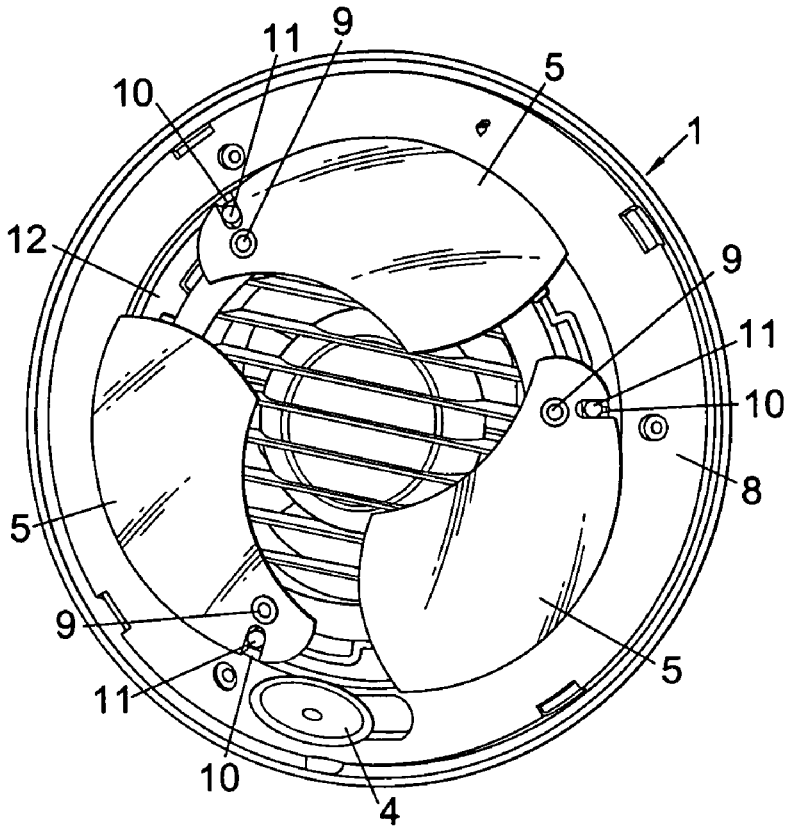
FIG. 3 is a sketch isometric view of ventilation device of FIG. 1, with the face plate removed.

FIG. 3 shows the appearance of the ventilation device 1 with the cover plate 2 removed. A drive support 8 can be seen in the form of an annular structure. The three closure parts 5 are shown. Each is pivoted at a pivot 9 which is located near the periphery of the aperture 3 but not actually visible through the aperture 3. Further, each closure part 5 comprises a drive part in the form of a notch 10 which engages a drive post 11 which is itself mounted on an annular drive member 12 mounted in an annular track on the drive support 8. It can be seen that rotation of the drive member 12 in anti clockwise direction (from the point of view of the observer) will cause the drive post 11 to drive the notch 10 in an anti clockwise direction around the pivot point 9 thus causing each respective closure part 5 to rotate in an anti clockwise direction, leading to the aperture becoming open.

Figure 4:
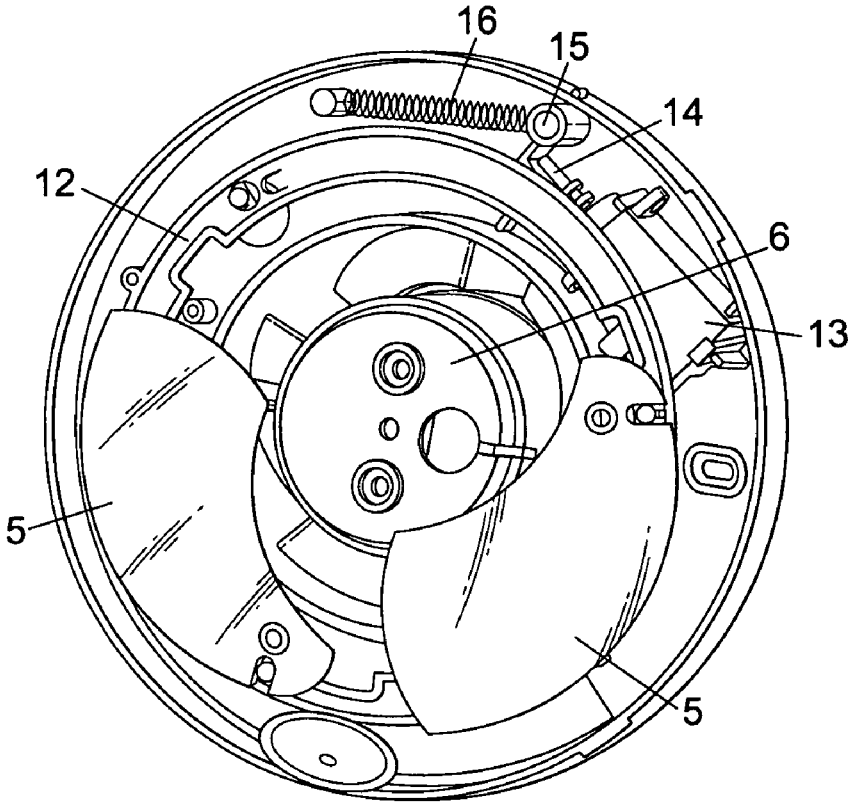
FIG. 4 is a sketch isometric view with some parts of the ventilation device removed, to show the drive means.

FIG. 4 is a sketch view with the drive support 8 removed. However, the drive member 12 and two of the closure parts 5 are shown in position, so that the operation can be understood.

The grille and the aero dynamic fairing from the top of the ventilation fan 6 have been removed as well. A wax actuator 13 of conventional design is provided. An actuator rod 14 is pushed in the direction of the top left hand corner of the page, seen looking into FIG. 4, when the wax actuator is switched on. This causes a push part 15 to act on the drive means 12, forcing it to rotate in an anti clockwise direction.

A coil spring 16 is shown also acting on the push part 15. The coil spring is designed so that, when the wax actuator is switched off, and the actuator rod 14 moves in the direction of the bottom right hand corner, the spring returns the drive member 12 to its original position, by rotating it in a clockwise direction. The drive member 12 then closes the closure parts by rotating the closure parts 5 in a clockwise direction.

Figure 5:
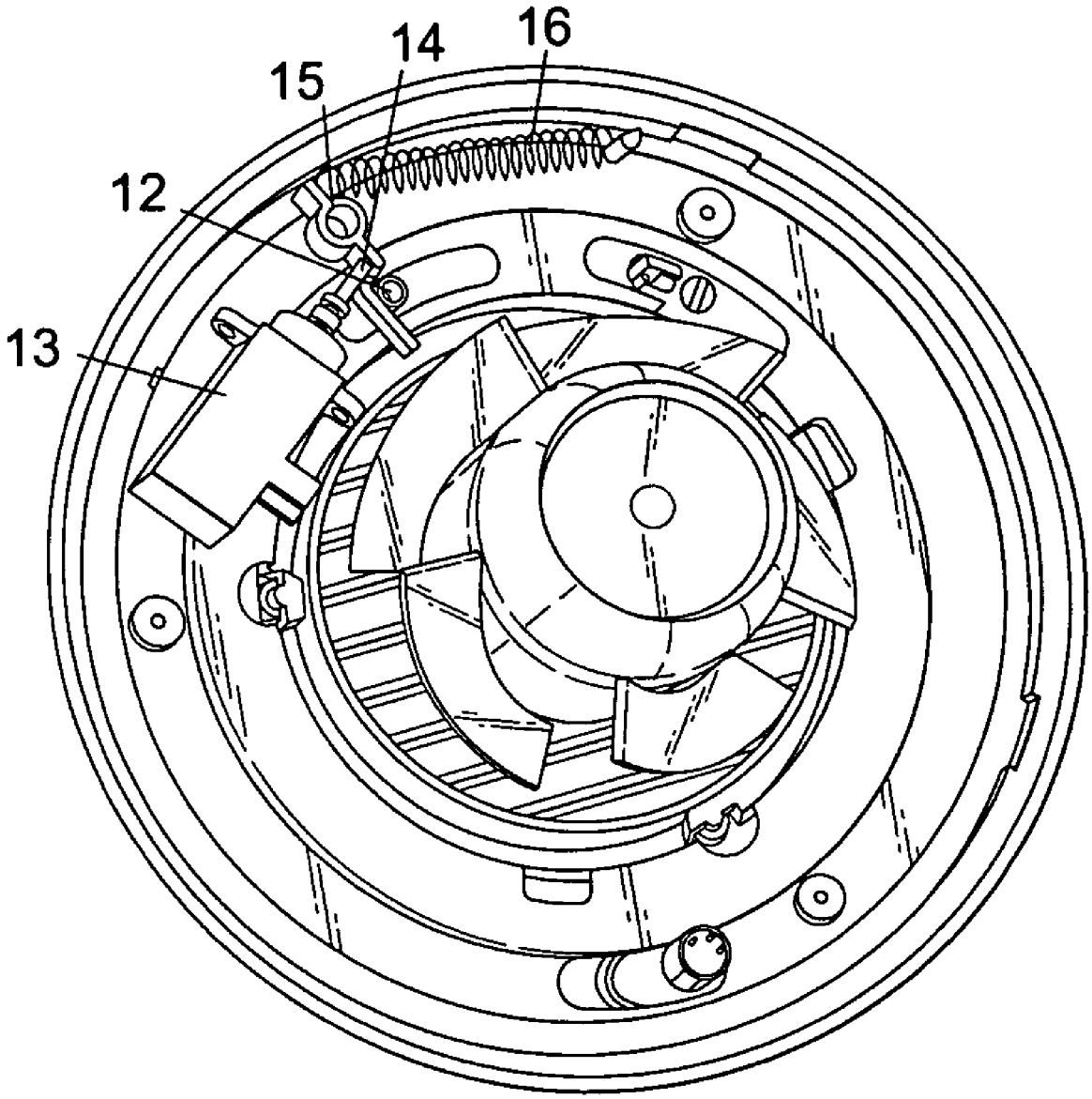
FIG. 5 is a sketch isometric view from the rear, with some parts removed, to show further aspects of the design.

FIG. 5 is a rear view showing the ventilation device with some parts removed. It shows a further detail of the wax actuator 13 and the push part 15. It can be seen that the push part 15 is rotatable about an axis so that when the actuator rod 14 extends, a stub of the push part moves in the opposite direction to the actuator rod thereby tensioning the coil spring 16. The other end of the push part 15 drives a part of the drive means 12 so that it rotates. As FIG. 5 is seen from the opposite side to FIG. 4, in the view of FIG. 5, the drive means 12 is rotated in a clockwise direction to open the closure parts.

The present invention has been described above by way of example and modifications can be made within the invention. The invention also extends to equivalents of the features described. The invention also consists in any individual features described or implicit herein or shown or implicit in the drawings or any combination of any such features or any generalisation of any such features or combination.

The invention claimed is:

1. A ventilation device, having:

a face for facing into a room, the face including an aperture having a periphery;

at least three closure parts, for closing the aperture, rotatably mounted adjacent to the aperture about pivot points located around the periphery of the aperture, wherein the closure parts each comprise closure surfaces having edges abutting one another in the closed position, so as not to slide over each other when moving from an open to the closed position and from the closed to an open position, drive means for moving the closure parts between an open position and a closed position, and fan means for driving air through the aperture when the closure parts are in the open position, wherein the closure parts rotate about axes which are substantially normal to the plane of the aperture.

2. A ventilation device according to claim 1, comprising at least one drive member for contacting a drive part of a closure part, the drive part being located close to the pivot.

3. A ventilation device according to claim 2, wherein the distance between the pivot and the drive part is less than 50% and preferably less than 25% of a maximum extent of the closure part from the pivot.

4. A ventilation device according to claim 2, wherein the drive member comprises at least a section of an annular member, slidably mounted in an annular track.

5. A ventilation device according to claim 1, wherein the drive means comprises a wax actuator.

6. A ventilation device according to claim 1, wherein the pivot and the drive part are mounted on the same side of the closure part.

7. A ventilation device, having:

a face for facing into a room, the face including an aperture;

at least three closure parts, for closing the aperture, rotatably mounted adjacent to the aperture about pivot points located around the periphery of the aperture, drive means for moving the closure parts between an open position and a closed position, the drive means comprising at least one drive member for contacting a drive part of each closure part, the pivot being located on one side of the closures part, the pivot and the drive part being mounted on the same side of the closure part, said closure parts not sliding over each other when moving from said open to said closed position and from the closed to the open position, and fan means for driving air through the aperture when the closure parts are in the open position wherein the closure parts rotate about axes which are substantially normal to the plane of the aperture.

8. A ventilation device according to claim 7, wherein the pivot and the drive part are mounted on the side of the closure part facing away from a face for facing into the room.

* * * * *